US005520311A

United States Patent [19]

Lam

[11] Patent Number: 5,520,311

[45] Date of Patent: May 28, 1996

[54] GARMENT HANGER ASSEMBLY KIT

[76] Inventor: Peter A.-F. Lam, 20104 Wayne Ave., Torrance, Calif. 90503

[21] Appl. No.: 273,593

[22] Filed: Jul. 11, 1994

[51] Int. Cl.[6] ..... A47G 25/14; A47G 25/44

[52] U.S. Cl. ..... 223/85; 223/94; 223/89

[58] Field of Search ..... 223/85, 87, 88, 223/89, 92, 94; 211/113; D6/315, 328, 324; 446/87, 88; 224/223

[56] References Cited

U.S. PATENT DOCUMENTS

| | | | |
|---|---|---|---|
| 2,814,426 | 11/1957 | Miller | 223/94 |
| 3,039,662 | 6/1962 | Strong | 223/89 |
| 3,634,965 | 1/1972 | McAuley | 446/88 |
| 4,717,053 | 1/1988 | Wang | 223/94 |
| 4,932,571 | 6/1990 | Blanchard | 223/89 |

FOREIGN PATENT DOCUMENTS

| | | | |
|---|---|---|---|
| 1024904 | 4/1953 | France | 223/94 |
| 5305185 | 11/1993 | Japan | 446/87 |

*Primary Examiner*—C. D. Crowder
*Assistant Examiner*—Bibhu Mohanty
*Attorney, Agent, or Firm*—Freilich Hornbaker Rosen

[57] ABSTRACT

An integrally formed plastic body configured to provide one or more structural members which can be readily assembled by an end user to form a garment hanger. The plastic body incorporates one or more structurally weakened regions which can be readily severed to create separate parts and/or a groove around which adjacent parts can be hinged to erect and collapse the hanger.

6 Claims, 7 Drawing Sheets

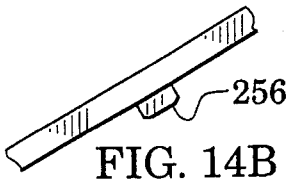
FIG. 14B
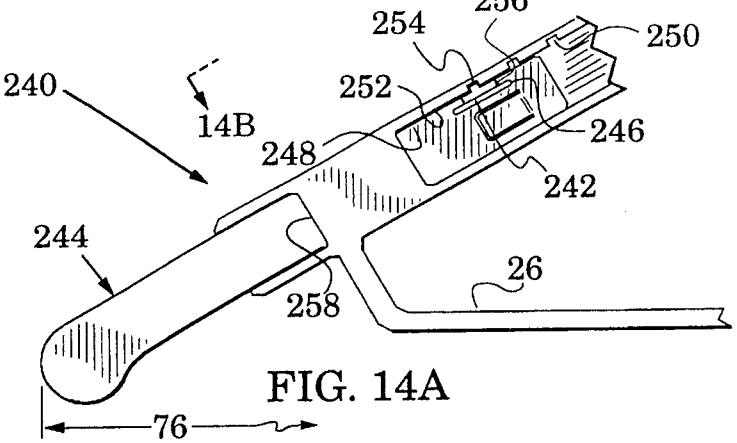
FIG. 14A
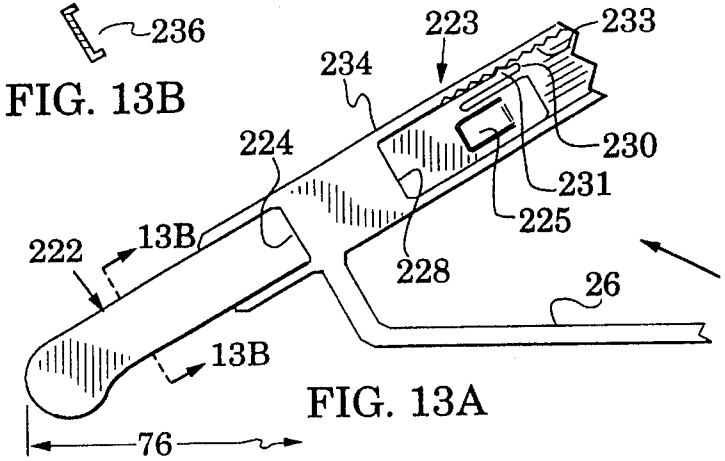
FIG. 13A
FIG. 13B
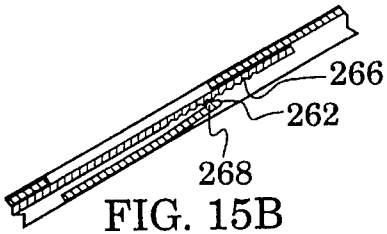
FIG. 15B
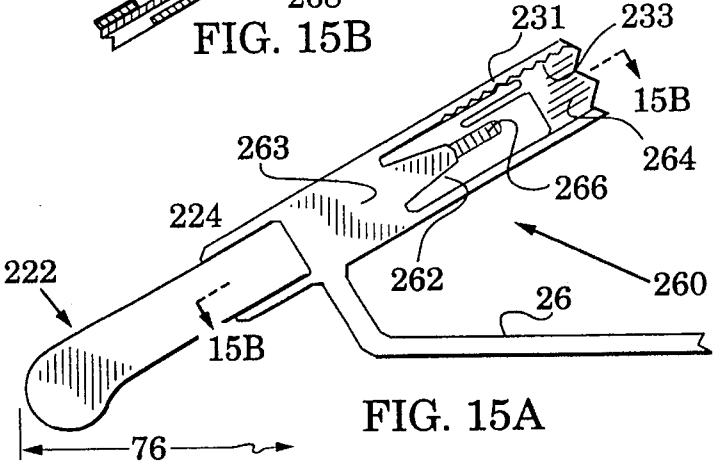
FIG. 15A

GARMENT HANGER ASSEMBLY KIT

FIELD OF THE INVENTION

This invention relates to an article of manufacture configured to be readily assembled by an end user to form a garment hanger.

BACKGROUND OF THE INVENTION

The prior art is replete with various configurations of garment hangers including hangers which incorporate structure for selectively adjusting the hanger's width to accommodate different size garments. U.S. Pat. Nos. 5,052,599; 5,085,358; 5,102,019, and the references cited therein, exemplify such constructions.

The prior art also shows garment hangers which can be assembled or erected (or disassembled and collapsed) by an end user, primarily for the purpose of conserving shipping and/or storage space. U.S. Pat. Nos. 2,446,312, 3,401,855, 4,227,632, 4,673,115, 4,932,571 and 5,074,446 are exemplary of such constructions.

SUMMARY OF THE INVENTION

The present invention is directed to various articles of manufacture configured for manipulation by an end user to form a garment hanger. A preferred embodiment comprise an integrally molded plastic body incorporating two or more parts structurally interconnected by a weakened portion, hereinafter referred to as "sprue connected" which an end user can sever to separate those parts. The end user can then assemble the separated parts to form a garment hanger.

It is intended that articles of manufacture in accordance with the invention be distributed to end users packaged as a kit including interconnected plastic parts which can be readily separated and assembled or erected by an end user into a useful garment hanger. Such articles, comprising an integrally molded plastic body can be configured to form hangers of various types and sizes including triangular hangers, adjustable width hangers, skirt hangers, clamp hangers, etc.

In one preferred width adjustable hanger embodiment, the integral plastic body is characterized by a frame that defines a medial portion and first and second proximal arms extending therefrom, a suspension member, and first and second distal arms. The body is configured with the distal arms being sprue connected to the frame so that they can be readily detached therefrom. Each distal arm is configured to be adjustably carried by a different one of the proximal arms to define a garment supporting span across the distal arms. Each of the proximal arms defines a plurality of recesses and each of the distal arms defines a pin receivable in a selected one of the recesses enabling the garment supporting span to be adjusted.

In another preferred width adjustable hanger embodiment, the proximal and distal arms are configured with mating guide structures which allow relative slidable movement. More particularly, the proximal and distal arms define a mating channel and slide which can be engaged by inserting the distal arm into an open free end of the proximal arm. A resilient stop member on one of the arms allows easy engagement but prevents easy disengagement.

Other embodiments of the invention incorporate flexible regions in a plastic body, or part thereof, which act as hinges enabling adjacent structural elements to be folded relative to one another. Such hinged parts are used with or without separate connector parts, which may have previously been sprue connected, to form alternative garment hanger embodiments. Such hinges allow adjacent elements to hinge between open and closed orientations. With hinges incorporated in the proximal arms of a frame, for example, adjacent portions of the arms can be hinged closed to collapse the hanger to facilitate shipping or packing. The hanger can then be erected by hinging the adjacent elements open.

In accordance with a useful feature of a preferred embodiment, the integral plastic body includes a suspension member sprue connected to the frame for detachment therefrom.

In accordance with a useful feature of the adjustable width hanger embodiments, the kits therefore preferably include an adjustable garment size indicator.

It is contemplated that embodiments of the invention may incorporate, in addition to the aforementioned plastic parts, parts formed of other materials such as wood, ceramic, or fabric to enhance appearance.

The novel features of the invention are set forth with particularity in the appended claims. The invention will be best understood from the following description when read in conjunction with the accompanying drawings.

BRIEF DESCRIPTION OF THE FIGURES

FIG. 13A is a front elevation view of an alternative configuration of proximal and distal arms for a width adjustable embodiment;

FIG. 13B is a section view taken substantially along the plane 13B—13B of FIG. 13A;

FIG. 14A is a front elevation view of a further alternative configuration of proximal and distal arms for a width adjustable embodiment;

FIG. 14B is a section view taken substantially along the plane 14B—14B of FIG. 14A;

FIG. 15A is a front elevation view of a still further alternative configuration of proximal and distal arms for a width adjustable embodiment;

FIG. 15B is a section view taken substantially along the plane 15B—15B of FIG. 15A;

DESCRIPTION OF THE PREFERRED EMBODIMENTS

Figure 1:
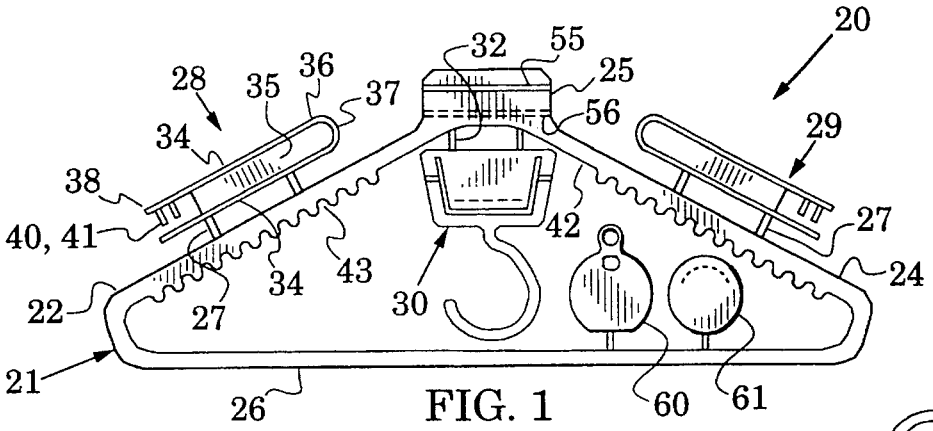
FIG. 1 is a front elevational view of an integral plastic body containing multiple sprue connected parts which can be separated by an end user to assemble a width adjustable garment hanger.

Attention is first directed to FIG. 1 which illustrates an unassembled hanger 20 comprising an integrally molded plastic body 21 incorporating structurally weakened sprue connections and groove hinges. The body 21 defines a plurality of parts intended for manual assembly by an end user to create a garment hanger. The body 21 includes proximal arm portions 22, 24 which extend laterally from a medial portion 25, and also includes a cross brace 26 that joins outer portions of the proximal arm portions and is thus arranged to support folded garments, e.g., slacks. The body 21 further includes sprue 27 connecting distal arm portions 28, 29, respectively, to different proximal arm portions 22, 24. The body 21 additionally includes a suspension member 30 which is sprue joined to the medial portion 25 via sprue 32.

The distal arm portions 28, 29 each have a U-shaped cross section formed of spaced walls 34 connected by a floor 35. The spaced walls 34 are joined at one end 36 by an end wall 37. The floor 35 terminates short of the other end 38 of each distal arm portion. Proximate to the end 38, a pair of pins 40, 41 extend from one of the side walls 34 and terminate so that their ends are spaced from the other of the side walls 34. The underside 42 of each of the proximal arms 22, 24 defines a plurality of spaced recesses 43 that are dimensioned to receive the pins 40, 41.

Figure 2A:
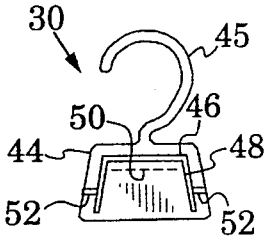
FIGS. 2A and 2B are respectively, front and side elevation views showing the suspension member part separated from the body of FIG. 1.
Figure 2B:
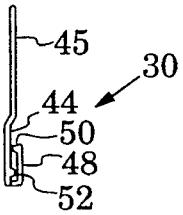

The suspension member 30 is shown separately in the front elevation view of FIG. 2A and in the side elevation view of FIG. 2B. The member 30 has a flat body 44 and, extending upward from the body 44, a hook member 45. The body 44 has a centrally located U-shaped cut 46 which, in turn, defines a resilient flap 48. The upper edge of the flap 48 forms a boss 50. A pair of bosses 52 are each spaced to either side of the flap 48 and spaced downward from the boss 50. The bosses 52 extend towards the flap 48 and the boss 50 extends towards the body 44.

As shown in FIG. 1, the medial portion 25 forms horizontally directed grooves 55, 56 on its opposite sides. The grooves 55, 56 are spaced vertically on the medial portion 25.

FIG. 1 additionally illustrates first and second parts 60, 61 of an optional size indicator sprue connected to the cross brace 26 of the integrally formed plastic body 21. The structure and function of the size indicator will be described hereinafter with respect to FIGS. 16–18.

Figure 3:
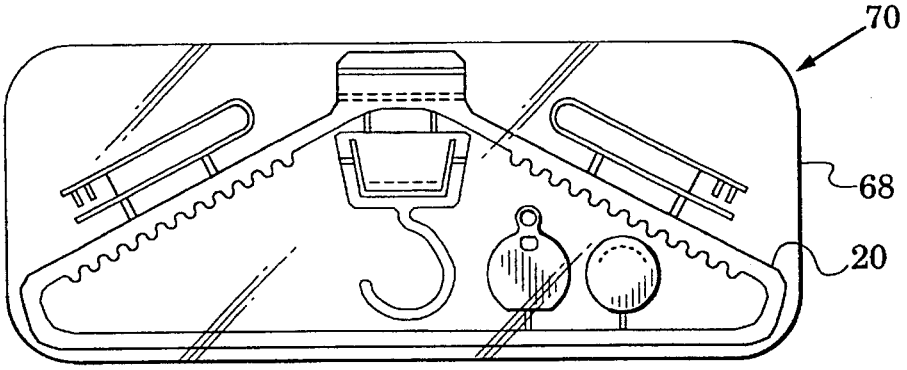
FIG. 3 is a front elevation view of the body of FIG. 1 sealed within a package suitable for sale to an end user as a kit of unassembled parts.

The integral body 21 is preferably molded from plastic material with the distal arms 28, 29 and the suspension member 30 sprue connected respectively to the proximal arms 22, 24 and medial portion 25. It is intended that the body 21 be distributed to end users in a protective shipping enclosure, suitable for retail sale, preferably formed of a transparent sealed envelope 68 as shown in FIG. 3. The envelope only protects the hanger 20 but visibly presents the hanger to buyers as an attractive point-of-sale assemblable 70.

A buyer can purchase the kit 70 and remove the integral body 21 from the enclosure 68. The suspension member 30 is then separated from the medial portion 25 by severing the sprue 32, inverted and pressed upward with the medial portion 25 received between the body 44 and the flap 48. The suspension member is pressed upward until the boss 50 and the bosses 52 are respectively received into the grooves 55, 56, interlocking the suspension member to the medial portion. The distal arms 28, 29 are separated from the proximal arms 22, 24 by severing the sprue 27. They are then each arranged to receive a different one of the proximal arms through the space between the ends of the pins 40, 41 and the adjacent side wall 34. Each distal arm is then allowed to drop downward until the floor 35 abuts the upper side of its respective proximal arm and the pins 40, 41 are received into selected ones of the recesses 43. The sprue is preferably severed or broken neatly and any remnants are disposed of.

Figure 4:
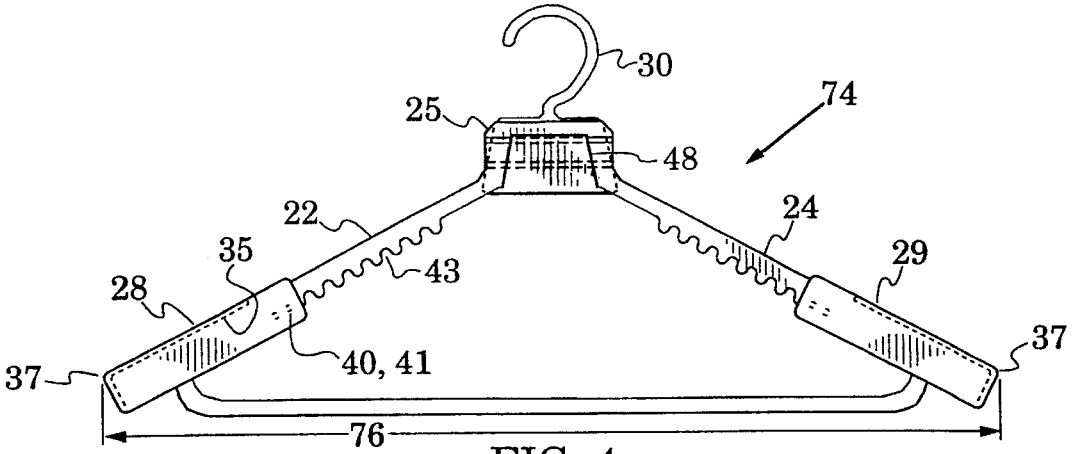
FIG. 4 is a front elevational view showing a garment hanger after assembly of the parts depicted in FIGS. 1–3.

In this way, the end user is able to transform the point-of-sale kit 70 into an assembled hanger 74 as shown in FIG. 4. The width of the lateral clothes supporting span 76 of the assembled hanger 74 is adjustable by selection of the recesses 43 that receive the pins 40, 41 of each of the distal arm portions 28, 29. A kit 70 is preferably sold with two or more hanger bodies of different colors. This enables a user to mix and/or match the colors of the separable parts (e.g., distal arms 28, 29; suspension member 30) and a hanger frame (i.e., proximal arms, medial portion, etc.) when assembling a unit to thus enhance its appearance.

Figure 5:
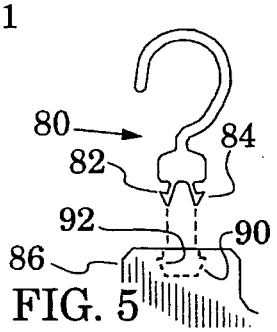
FIG. 5 is a front elevational view of an alternative suspension member.

FIG. 5 illustrates an alternative suspension member 80 for use in the hanger 20. The member 80 defines a pair of downward extending resilient prongs 82, 84 and the medial portion 86 of the hanger 20 is modified to define a socket 90 that forms an opposed pair of indentations 92. In operation, the suspension member 80 is pressed downward so that the prongs 82, 84 are received into the socket 90 to resiliently engage the indentations 92.

Figure 6:
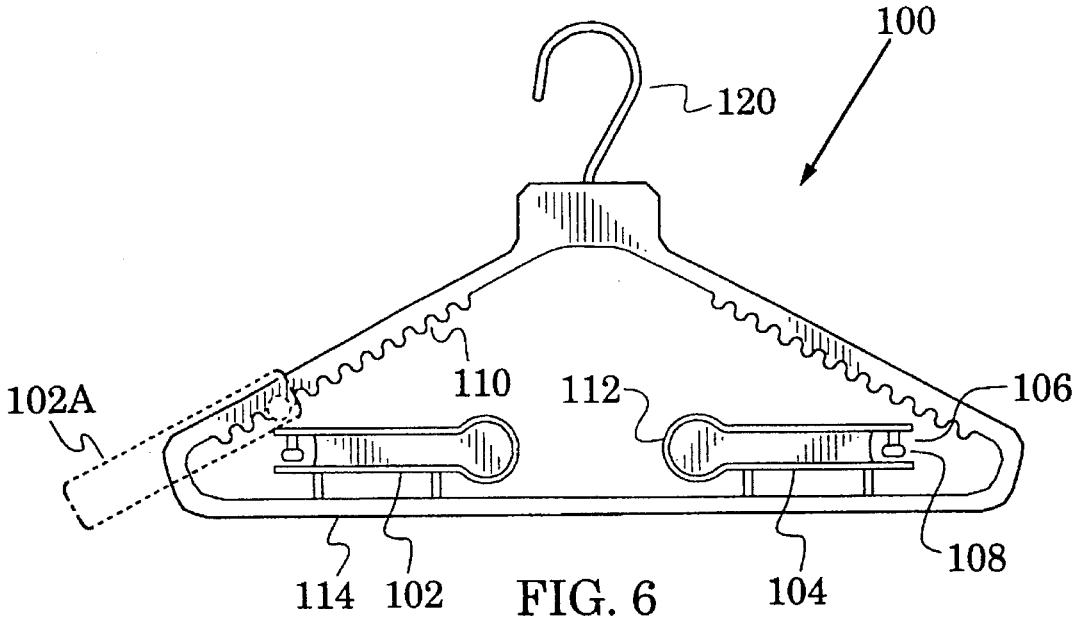
FIG. 6 is a front elevational view depicting a second width adjustable hanger embodiment which can be assembled by an end user after separating sprue connected parts.
Figure 7:
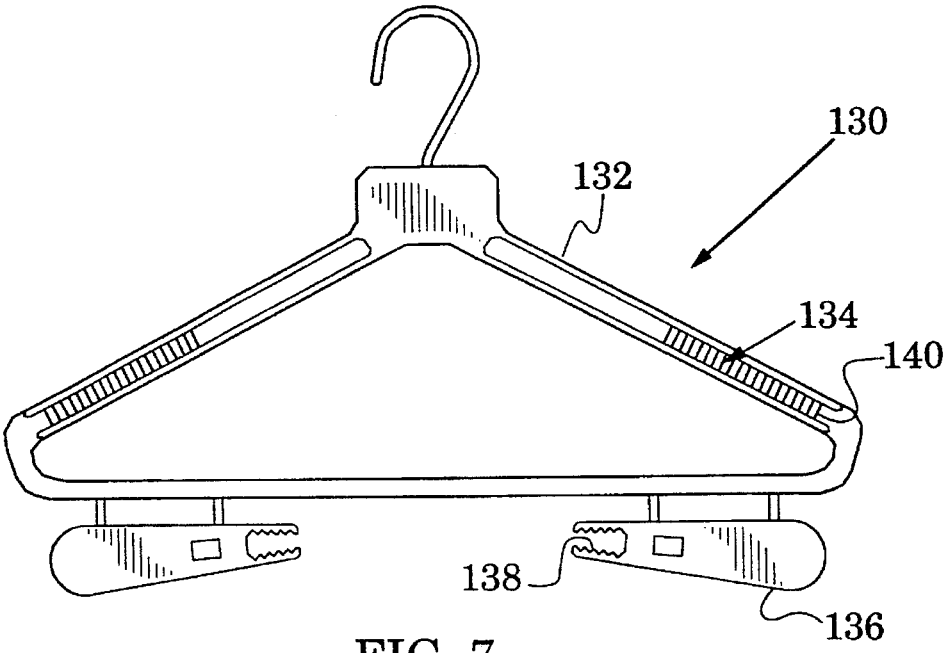
FIG. 7 is a front elevation view depicting a third width adjustable hanger embodiment which can be assembled by an end user after separating sprue connected parts.

FIGS. 6 and 7 are front elevation views of other preferred integrally molded, sprue connected hanger embodiments 100 and 130. The embodiments 100, 130 are also suited for forming point-of-sale kits similar to the kit 70 of FIG. 3.

The hanger 100 is similar to hanger 20 of FIG. 1 but its distal arm promotions 102, 104 each have a single pin 106 that replaces the double pins 40, 41. Each pin 106 terminates in an enlarged head 108. After assembly into an adjustable hanger similar to the hanger 74 of FIG. 4, the head 108 prevents the pin 106 from inadvertently slipping out of a selected one of a plurality of spaced recesses 110.

In FIG. 6, the distal arm 102 is shown in broken lines in an assembled position 102A on its respective proximal arm. The distal arms each have a rounded end wall 112 to conform with and support the shoulders of clothes such as coats. The distal arms are connected by sprues, in this embodiment, with the cross brace 114. Although the hanger 100 is illustrated with a conventional suspension member 120, it can, in other embodiments, include a sprue connected suspension member similar to the members 30 and 80 respectively shown in FIGS. 1 and 5.

The integrally molded, sprue connected hanger 130 of FIG. 7 is similar to the hanger 100 of FIG. 6 but incorporates structural elements disclosed in U.S. Pat. No. 5,082,152 (the disclosure of which is hereby incorporated by reference). Accordingly, the proximal arms 132 of the hanger 130 define racks 134 that replace the recesses 110 of the hanger 100. In addition, the distal arms 136 define clamping teeth 138 which engage selected notches 140 of the racks 134 when the distal arms are positioned in a manner similar to the broken line position 102A in FIG. 6.

Figure 9:
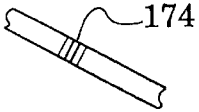
FIG. 9 is a section view taken substantially along the plane 9—9 of FIG. 8A.
Figure 8A:
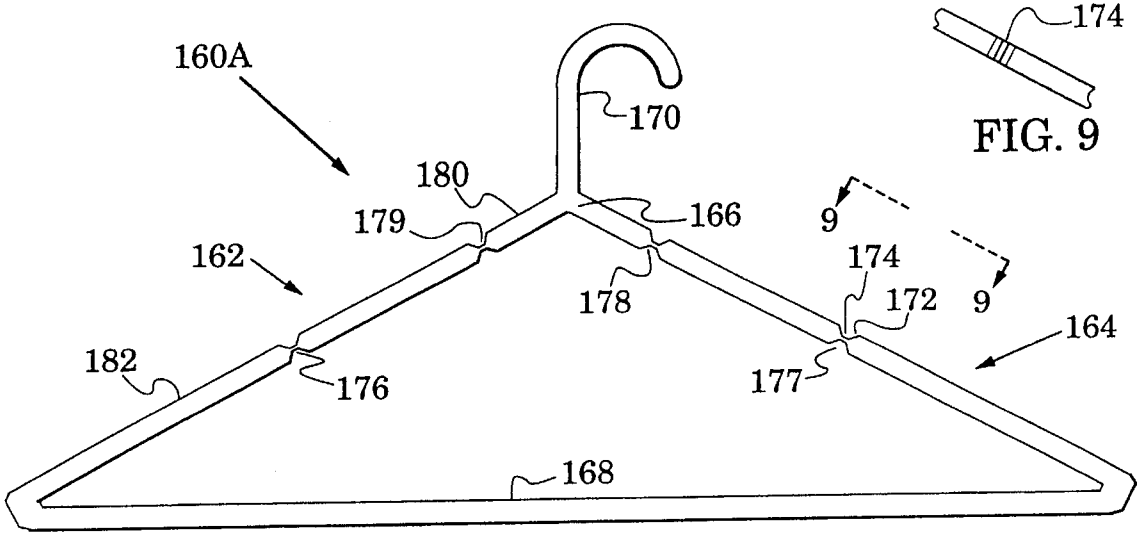
FIGS. 8A and 8B are front elevation views respectively showing a collapsible hanger embodiment in its erected and collapsed states.
Figure 8B:
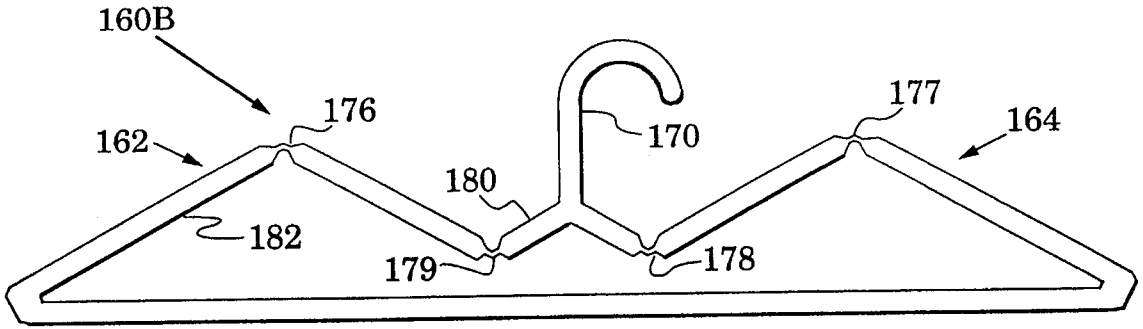

Another integrally molded hanger embodiment 160 is shown in an expanded state 160A in FIG. 8A and a collapsed state 160B in FIG. 8B. The hanger 160 has arms 162, 164 that extend outward from a medial portion 166. A cross brace 168 connects portions of the arms 162, 164 and a suspension member 170 extends upward from the medial portion 166. The hanger 160 is preferably molded from a plastic, e.g., polypropylene, suitable for forming "living hinges" as particularly shown in FIG. 9 which is a view of a hinge 177 formed of a flexible plastic region along the plane 9—9 of FIG. 8A. In this view, it is seen that the hinge 178 is comprised of a groove 172 that surrounds a resilient connecting web 174.

In a similar manner, the hanger 160 has grooves and webs at locations 176, 177, 178 and 179 that separate the arms 162, 164 into proximal portions 180 and distal portions 182. When the arms are folded at the living hinges of these locations, the hanger 160 is arranged in the collapsed state 160B of FIG. 8B which is especially suited for travel. For example, several hangers in the collapsed state 160B could be slipped into a small space in a piece of luggage and then unfolded into the expanded garment carrying state 160A of FIG. 8A for use at a destination. In its collapsed state 160B of FIG. 8B, the hanger 160 is also suited for packaging into an enclosure to form a point-of-sale kit similar to the kit 70 of FIG. 3.

Figure 10B:
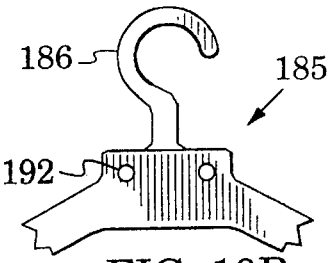
FIGS. 10A and 10B are front elevation views respectively showing an alternative suspension member in its preassembled and assembled orientations.
Figure 10A:
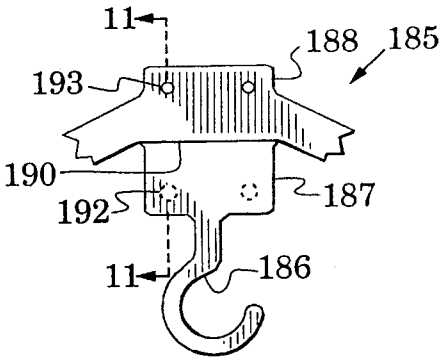
Figure 11:
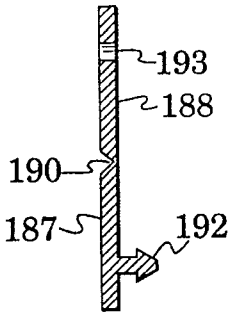
FIG. 11 is a section view taken substantially along the plane 11—11 of FIG. 10A.

FIG. 10A illustrates another suspension member embodiment 185 having a hook 186 extending from a body member 187 that is connected to a medial portion 188 by a living hinge 190. A pair of headed pins 192 are located in the body 187 to match a pair of holes 193 in the medial portion 188. This structure is also shown in FIG. 11 which is a view along the plane 11—11 of FIG. 10A.

In operation, the body member 187 is folded upward from the collapsed state of FIG. 10A until the headed pins 192 are releasably interlocked into the holes 193 to form the garment carrying state of FIG. 10B.

Figure 12A:
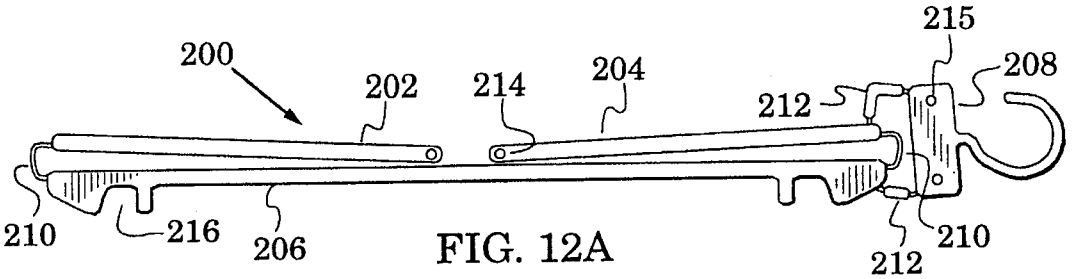
FIGS. 12A and 12B are front elevation views showing an alternative hanger embodiment incorporating both flexible hinge regions and a discrete sprue connected suspension member in its collapsed and erected states.

FIG. 12A illustrates another folding hanger embodiment 200 in accordance with the present invention. The hanger 200 is preferably molded in plastic as an integral part which includes a pair of proximal elongate arms 202, 204, a cross brace 206 and a separable medial or suspension member 208. The arms 202, 204 are preferably hinged at their first or interior ends by flexible plastic portions 210 to the cross brace 206. The member 208 is connected to the arm 204 and the cross brace 206 by disposable sprues 212. Holes 214 are defined in the exterior ends of the arms 202, 204 and laterally extending pins 215 are molded into the hook member 208. The cross brace 206 additionally defines an indentation 216 adjacent each end.

Figure 12B:
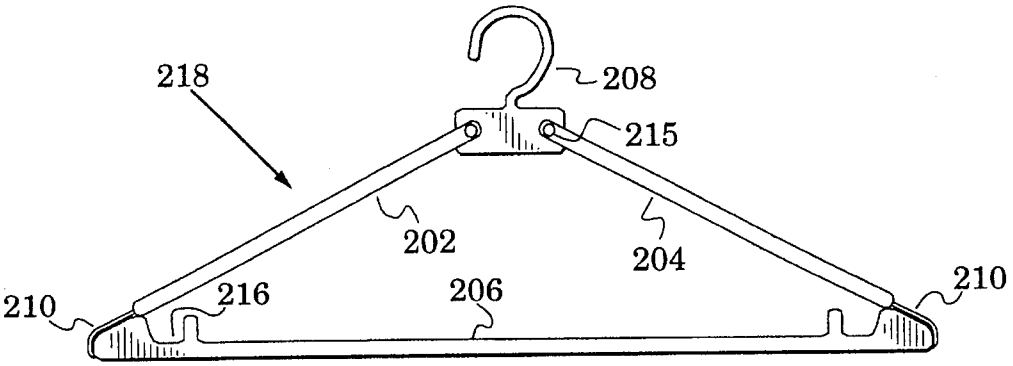

As shown in FIG. 12B, the integrally molded hanger 200 can be erected into a garment hanger 218. To erect the hanger 218, the sprues 212 are broken away to free the hook member 208. Then the arms 202, 204 are pivotally rotated on the flexible plastic portions 210 to the other side of the cross brace 206 where the holes 214 are detachably received over the hook pins 215, interlocking the arms 202, 204 to the hook member 208. The flexible plastic portions 210 extend around the upper surface of the ends of the cross brace 206. The arms 202, 204 are now arranged to support a coat-type garment and the cross brace 206 is arranged to support folded garments, e.g., slacks. The indentations 216 are arranged to support skirt straps and the like. The integrally molded hanger 200 is particularly suitable for travelers. Several of these units can be fitted into a small area of luggage and then assembled quickly into the hanger 218 when needed. In its collapsed state of FIG. 12A, the hanger 200 is also suited for packaging into an enclosure to form a point-of-sale similar to the kit 70 of FIG. 3. The use of the separate medial 208 for connecting the exterior ends of arms 202, 204, as shown in FIGS. 12A and 12B, minimizes the area of the unit and thus also minimizes injection molding costs.

Figure 12C:
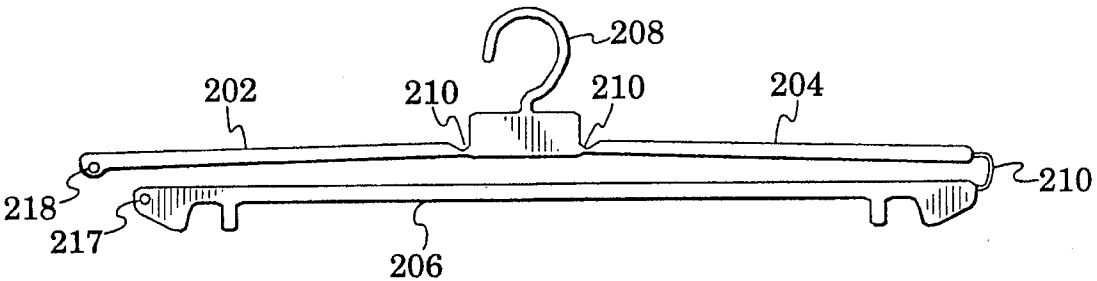
FIG. 12C is a front elevation view showing a further alternative hanger embodiment in its collapsed state.

FIG. 12C illustrates an alternative embodiment similar to that illustrated in FIGS. 12A–12B. In this embodiment the suspension hook member 208 is fixed to arms 202 and 204 using first and second flexible plastic portions 210. Additionally, a third flexible plastic portion 210 couples arm 204 to a cross brace 206. The exterior free end of the cross brace 206 is terminated with a hole 217 and a mating pin 218 is molded into the exterior free end of arm 202. Alternatively, of course, the free end of brace 206 can carry the mating pin 218 and the free end of arm 202 can define the hole 217. When the free ends of the cross brace 206 and the arm 202 are interlocked together, a garment hanger is formed similar to that shown in FIG. 12B. As previously described, indentations may be provided for skirt straps.

Several adjustable width hanger embodiments have already been discussed in connection with FIGS. 1–7. Additional adjustable width embodiments are depicted in FIGS. 13–15. For example, FIG. 13A is a partial view of an adjustable hanger embodiment 220 in which the distal arm 28 and proximal arm 22 of FIG. 1 have been replaced with distal arm 222 and proximal arm 223. The proximal arm 223 forms a guide channel 224 and the distal arm 222 is slidably received into this guide channel 224. The distal arm defines a resilient flap or stop 225 which prevents inadvertent removal from the proximal arm 223 by abutment with a stop 228 formed on the proximal arm 223. The distal arm 222 includes, adjacent its inner end, a resilient finger 230. The finger 230 has a projection 231 which is urged upward to engage one of a plurality of notches 233 defined in the upper wall 234 of the guide channel 224. In operation, after severing the sprue connected distal arm from its integral body, a user inserts the distal arm 222 through the channel opening defined in the outer end of proximal arm 223 until resilient flap 225 passes stop 228. Then the user can adjust the hanger width by engaging the resilient finger projection 231 with a selected notch 233. The distal arm 222 may have its rigidity increased by forming its cross section configuration as a U-shaped channel 236 as shown in the FIG. 13B which is a view along plane 13B—13B of FIG. 13A. Once the distal arm 222 is engaged with the proximal arm 223 by moving the flap 225 inwardly past stop 228, the arms can not be inadvertently disengaged because the flap and stop will abut. While engaged, the distal arm portion 220 is moved within the guide channel 224 to achieve a desired garment supporting span 76.

FIG. 14A illustrates another slidable distal arm embodiment 240. The embodiment 240 is similar to the embodiment 220 of FIG. 13A but replaces the resilient finger 230 with a resilient floor 242. The resilient floor 242 is defined in the distal arm portion 244 by an open slot 246 spaced from the upper edge 248 of the portion 244. A plurality of indentations 250 are defined in the upper channel wall 252. An ear 254 is defined on the upper edge of the floor 242 and this ear is urged by floor 242 to be received into a selected one of the indentations 250. As shown in FIG. 14B, which is a view along the plane 14B—14B, the floor 242 has a transversely extending handle 256. To adjust the garment carrying span 76, the handle 256 is pressed to urge the resilient floor 242 downwards until the ear 254 clears the indentations 250. The distal portion 244 can then be slid within the guide channel 258 to a new position which is locked by engagement of the ear 254 with a different one of the indentations 250.

FIG. 15A illustrates another slidable distal arm embodiment 260 which is similar to the embodiment 220 of FIG. 13A but includes a resilient arm 262 defined by a guide channel wall 263. The arm 262 urges the inward end of the distal portion 222 against the closed transverse wall 264 of the guide channel 224. This urging insures continued engagement between the projection 231 and a selected notch 233. FIG. 15B is a sectional view along the plane 15B—15B of FIG. 15A. This view and FIG. 15A also illustrate an alternative structure for selective adjustment of the distal portion 222 position. A plurality of notches 266 are defined on the distal portion and a boss 268 is defined on the inward transverse side of the arm 262. The resilience of the arm 262 urges the boss 268 into engagement with a selected one of the notches 266. Although FIGS. 13–15 depict three specific structures for mating distal and proximal arms for relative sliding movement, many other variations are contemplated in accordance with the invention. For example, the respective mating cross-sections of the arms could be interchanged.

Figure 16:
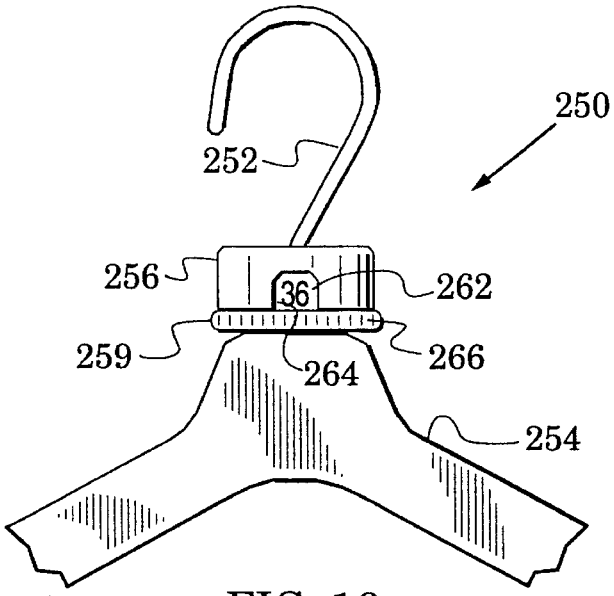
FIG. 16 is a front elevation showing an adjustable garment size indicator which can be optionally used with the various hanger embodiments.

The hanger kit 70 illustrated in FIG. 3 may also include an optional garment size indicator 250 as shown in FIG. 16 installed over the suspension member 252 of an exemplary hanger 254. The garment size indicator 250 is adjustable to indicate the size of a garment. Details of the indicator 250 are further shown in FIG. 17 which is a partial, enlarged, sectional view. The indicator has a collar 256 that forms an annular inward directed boss 258 and a drum 259 that forms an annular channel 260. The drum 259 is pressed into the collar 256 with the boss 258 rotatably received into the channel 260. The drum 259 bears indicia 262 in the form of garment sizes and the collar 256 has an index, e.g., a window 264, that specifies a selected indicia as the drum 259 is rotated within the collar 256. The drum also defines a knurled rim 266 to facilitate its rotation. Holes 267 and 268 in respectively the collar 256 and drum 259 allow the indicator to be received over the suspension member 252.

Figure 17:
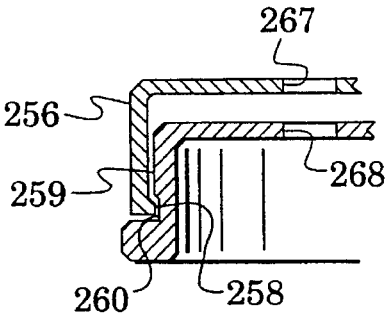
FIG. 17 is an enlarged partial section view of the indicator of FIG. 16.
Figure 18A:
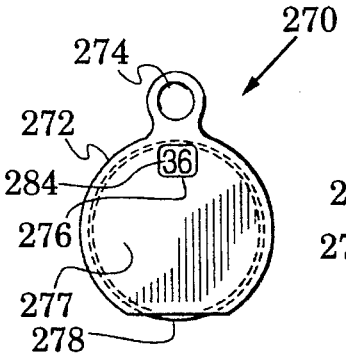
FIGS. 18A and 18B are, respectively, front elevation and side section view of an alternative adjustable garment size indicator.
Figure 18B:
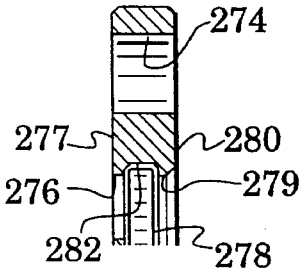

Another indicator embodiment 270 is illustrated in the front and sectional side elevation views respectively of FIGS. 18A and 18B. The embodiment 270 includes a shell 272 having a hole 274 to be received over a suspension member and a window 276 in the front face 277 of the shell. A wheel 278 is rotatably pressed through a beveled opening 279 in the back face 280 of the shell 272. The wheel 278 then freely rotates in an annular channel 282 of the shell 272. The wheel 278 bears the size indicia 284 that is displayed through the window 276. As shown in FIG. 18A, the shell 272 may be relieved upward to expose a portion of the wheel 276 to facilitate rotation by an end user. Although the size indicator embodiments of FIGS. 16–18 are depicted with only a single index and a single indicia scale, it is pointed out that, in certain circumstances, it may be preferably to provide an indicator with more than one index and/or scale to facilitate viewing from different orientations.

Figure 19:
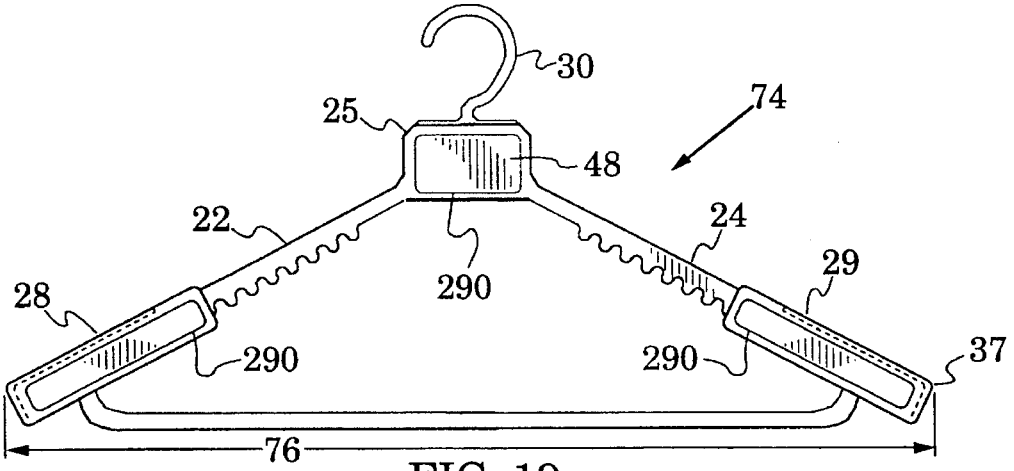
FIG. 19 is a front elevation view of a hanger embodiment showing how a decorative veneer can be applied thereto to enhance appearance.

While the hanger kit embodiments disclosed above are preferably formed by plastic molding, they may be enhanced in appearance by applying a veneer 290, for example, to the medial portion 25 having a substantially flat face and/or the distal arms 28, 29 as shown in FIG. 19 which is a view similar to FIG. 4. The veneer 290 is formed of a decorative material, e.g., wood, ceramic, leather, fabric, and applied with conventional bonds, e.g., glue.

Figure 20:
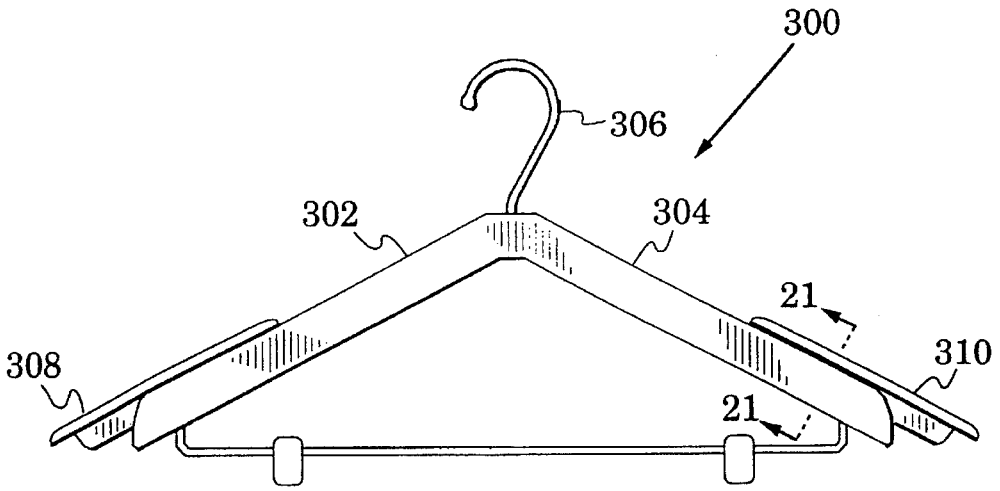
FIG. 20 is a front elevation view showing how adjustable distal arms in accordance with the invention can be integrated with a wooden hanger frame to provide width adjustability.

With reference now to FIG. 20 there is shown a front elevation view showing an alternative embodiment of a garment hanger 300 that integrates the present invention with a wooden hanger frame to provide an adjustable width wooden hanger. In this embodiment, proximal arm portions 302, 304 extend laterally from a suspension member 306. Additionally, distal arms 308, 310 are adjustably coupled to proximal arm portions 302, 304, respectively. In this embodiment, the forward facing exposed surfaces of the distal and proximal arm portions are substantially covered with wood as described further below.

Figure 21:
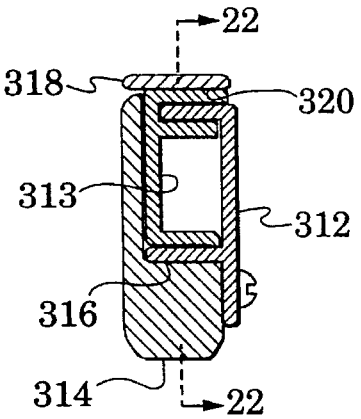
FIG. 21 is a section view taken substantially along the plane 21—21 of FIG. 20.

With reference to FIG. 21 there is shown a view along the plane 21—21 showing a cross section of the proximal and distal arms, 304, 310, respectively. The proximal arm 304 is comprised of a wood facade 314 having an elongate channel defining guide member 312 bonded thereto using conventional means, e.g., glue., at a first bonding surface 316. The guide member 312 can be formed of plastic, metal, or some other non-wood material. The distal arm 310, comprising an elongate member 313, is preferably formed of plastic, metal, or some other non-wood material, and has an E-shaped cross section. The distal arm 310 is mounted for adjustable sliding movement in the channel defined by guide member 312. A second wood facade 318 is bonded to a second bonding surface 320 of the member 313. As previously discussed, the size of a garment that can be accommodated by the garment hanger 300 can be altered by sliding member 313 relative to the channel member 312.

Figure 22:
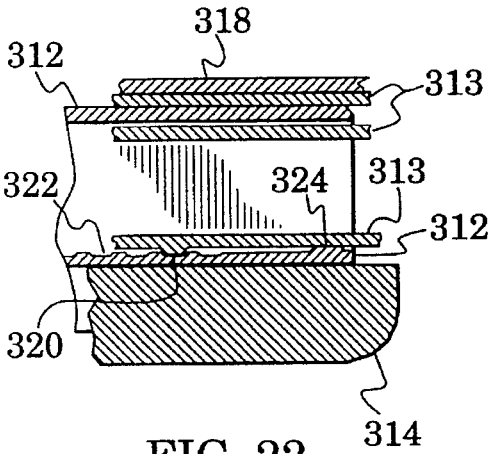
FIG. 22 is a section view taken substantially along the plane 22—22 of FIG. 21.

With reference to FIG. 22, a section view across the plane 22—22 is shown. The slide member 313 has a finger 320 that is used to adjustably position the slide relative to the channel 312 as well as limiting the extent of its relative movement. The interior of channel member 312 is formed with a plurality of notches 322 and a stop 324. As previously described, the finger 320 detents into a selected notch 322 as manually adjusted by the end user to alter the span of the garment hanger 300. However, the stop 324 is used to limit the relative movement by not permitting the finger 320 to go past the stop 324.

From the foregoing, it should now be recognized that various articles of manufacture have been disclosed herein configured to provide one or more structural members which can be readily assembled by an end user to form a garment hanger. Embodiments of the invention are characterized by an integrally formed plastic body incorporating a structurally weakened region comprising severable sprue and/or a groove hinge. By severing a sprue and/or folding adjacent parts about the hinge, an end user can readily assemble a garment hanger. Preferred disclosed embodiments incorporate adjustable distal arm portions for varying the hanger's lateral width to accommodate differently sized garments. It should be understood that the embodiments described herein are exemplary and numerous modifications, dimensional variations and rearrangements can be readily envisioned to achieve an equivalent results, all of which are intended to be embraced within the scope of the appended claims.

What is claimed is:

1. A garment hanger kit configured for point-of-sale display comprising:

an integrally molded plastic body including a suspension member and a frame having (1) a medial portion and (2) first and second elongate support arms diverging from said medial portion to define an obtuse angle therebetween; and first and second distal portions directly interconnected by sprue to said frame, said sprue being physically configured so that it can be readily severed to separate said distal portions from said frame;

said distal portions being configured for mounting on said support arms for movement with respect thereto to adjust the width of said garment hanger.

2. The garment hanger of claim 1 wherein said frame further includes a brace interconnecting said support arms.

3. The garment hanger kit of claim 1 wherein said plastic body has a first color; and further including at least a second integrally molded plastic body configured substantially identical to said first mentioned plastic body, said second body having a second color different from said first color; and means packaging together said first and second plastic bodies for enabling a user to cross assemble body portions of said first color with body portions of said second color.

4. The garment hanger kit of claim 1 wherein said suspension member is interconnected to said frame by sprue physically configured to enable said suspension member to be readily severed from said frame;

said suspension member and said medial portion being physically configured to cooperatively interlock to enable an end user to assemble a garment hanger.

5. The garment hanger kit of claim 1 wherein said suspension member is connected to said medial portion through a flexible plastic region forming a hinge.

6. A point of sale garment hanger kit comprising:

an integrally molded runnerless plastic body including:

a suspension member;

first and second elongate support members;

first and second elongate distal members;

at least one of said members being configured to be readily severable from said body, said severable member being configured to be physically interlocked with at least one other of said members for manual assembly of said members by an end user to form a finished garment hanger wherein said support members respectively extend in opposite lateral directions from said suspension member and define an obtuse angle therebetween; and wherein said first and second distal members are configured for respective mounting on said first and second support members for movement with respect thereto to adjust the width of said garment hanger.

* * * * *